US006685763B1

(12) United States Patent
Bertrand et al.

(10) Patent No.: US 6,685,763 B1
(45) Date of Patent: Feb. 3, 2004

(54) TREATMENT FOR IMPROVING THE CASTABILITY OF ALUMINUM KILLED CONTINUOUSLY CAST STEEL

(75) Inventors: Florence Bertrand, Metz (FR); Jean Lehmann, Metz (FR); Laurent Sosin, Florange (FR)

(73) Assignee: USINOR, Puteaux (FR)

( * ) Notice: Subject to any disclaimer, the term of this patent is extended or adjusted under 35 U.S.C. 154(b) by 0 days.

(21) Appl. No.: 09/936,300

(22) PCT Filed: Mar. 29, 2000

(86) PCT No.: PCT/FR00/00779

§ 371 (c)(1),
(2), (4) Date: Sep. 12, 2001

(87) PCT Pub. No.: WO00/62957

PCT Pub. Date: Oct. 26, 2000

(30) Foreign Application Priority Data

Apr. 15, 1999 (FR) ..... 99 04703

(51) Int. Cl.[7] ..... C21C 7/06
(52) U.S. Cl. ..... 75/568
(58) Field of Search ..... 75/568, 304, 305

(56) References Cited

U.S. PATENT DOCUMENTS 4,134,196 A * 1/1979 Yamaji et al. ..... 419/3
4,944,798 A * 7/1990 Ototani

FOREIGN PATENT DOCUMENTS

| | | |
|---|---|---|
| EP | 0 030 043 | 6/1981 |
| EP | 0 512 118 | 11/1992 |
| EP | 0 829 546 | 3/1998 |

OTHER PUBLICATIONS

Patent Abstract of Japan, vol. 011, No. 140, Dec. 6, 1986.
Patent Abstract of Japan, vol. 010, No. 142, Jan. 7, 1986.
Patent Abstract of Japan, vol. 310, No. 310, Apr. 18, 1989.
Patent Abstract of Japan, vol. 1998, No. 03, Nov. 4, 1997.
Patent Abstract of Japan, vol. 1998, No. 01, Sep. 2, 1997.

* cited by examiner

*Primary Examiner*—Melvyn Andrews
(74) *Attorney, Agent, or Firm*—Sughrue Mion, PLLC

(57) ABSTRACT

According to this treatment, calcium is added to ultra low molten steel or low carbon which is aluminum killed (or in the course of being killed) in order to form non-metallic deoxidation inclusions that have a melting point which is below the casting temperature; the molten metal is maintained in the chain of treatment ranging from the ladle refining installation to the copper mold with a low minimum low magnesium content of approximately 2 ppm. The inventive method increases the scope of fusibility of the inclusionary population of steels, thereby improving the castability of high aluminum-killed ultra low carbon grades without the need for argon bubbling.

9 Claims, 2 Drawing Sheets

TREATMENT FOR IMPROVING THE CASTABILITY OF ALUMINUM KILLED CONTINUOUSLY CAST STEEL

FIELD OF THE INVENTION

The present invention relates to the continuous casting of steel. It relates more particularly to preventing the casting nozzle from being blocked when casting a slab or strip made of killed steel, especially low-carbon steel or ultralow-carbon steel (called ULC steel or IFS).

PRIOR ART

It is known that the continuous casting of semi-finished products of wide cross section (slab, thin slab, strip, etc.) conventionally requires the use of a submerged nozzle to feed the casting mold with molten metal from the tundish placed above it.

It is also known that these nozzles are subject to fouling resulting, in the relatively long term, in them being completely blocked and, consequently, resulting in the casting run in progress being immediately stopped.

It will be recalled that fouling is a phenomenon involving the gradual narrowing, from the periphery toward the centre, of the pipe that the nozzle offers the liquid metal in order for it to pass into the mold. The origin of this phenomenon is the deposition of solid particles on the inner wall of the nozzle, these particles being non-metallic inclusions from the deoxidation of the liquid metal. These inclusions are already present within the molten metal following the metallurgical treatments undergone beforehand by the latter, or they form during actual flow through the nozzle if the latter is not sufficiently impervious to the oxygen from the ambient atmosphere. The number and the volume of these non-metallic inclusions vary with the steel grades cast, as does the extent to which they solidify at the temperature of the molten metal.

In this regard, it is known that serious castability difficulties may arise, particularly in the case of the casting of low-carbon steel or ultralow-carbon steel (of the IFS type, for example), and therefore in highly killed steel.

Conventionally, steels of this type are killed in the refining ladle by the addition of aluminum, this being a deoxidizing agent widely used in iron and steel manufacture. The deoxidation reaction produces aluminates which predominantly settle on the surface of the molten metal, firstly in the ladle and then in the tundish. However, some of these non-metallic inclusions inevitably remain suspended within the mass of liquid metal at the moment of casting. In particular, it is these particles which, during their transit through the nozzle, become attached to the wall of the pipe and, via an accretion phenomenon over time, end up by blocking the passage.

It is known to prevent these blockages by making a stream of inert flushing gas (especially argon) flow through the nozzle. The mechanism, or more probably the mechanisms, via which such a gas flush counteracts the fouling has not yet been fully elucidated, but the result is generally rather satisfactory if the bubbling is installed right from the onset of the casting run. Otherwise, clumps of inclusions may become detached and contaminate the metal in a dramatic fashion, making this practice a remedy worse than the disease.

However, the method, even correctly applied, is not without undesirable side effects. Defects of the "blister" type may appear on strip during subsequent rolling, which are known to result in the phenomenon of gas bubbles being trapped within the in-mold solidified metal.

It is also known to prevent nozzle blockages by means of preventative measures, the primary benefit of this being to be able to dispense with the "argon bubbling". One of these measures consists in adding a flux, such as Ca (for example in the form of Si—Ca or Ca—Fe), to the molten metal before casting, and therefore in the tundish, or preferably already in the refining ladle, which flux will complex with the deoxidation aluminates to form more meltable inclusions, these therefore remaining in principle in the liquid state at the casting temperature. A preventative treatment of this type, by addition of calcium, is described for example in the document EP-A-0 512 118, the overall teaching of which will be considered as being incorporated into the present specification by reference.

However, such chemical treatment of the blocking does not always give the expected results. This is because it sometimes happens that the inclusions formed, even in the presence of calcium, are already in the solid state in the tundish, this being so even in the case of casting with significant overheating of the metal.

SUMMARY OF THE INVENTION

The object of the invention is specifically to achieve better fluidity of the oxidation inclusions that have formed by the calcium treatment of the molten metal before casting.

For this purpose, the subject of the invention is an in-ladle metallurgical treatment of a steel having to be continuously cast, in which calcium is added to a molten ultralow- or low-carbon steel which has been killed (or is in the process of being killed) with aluminum in order to achieve a given oxygen content, so as to form deoxidation inclusions having a melting point below the temperature at which the steel is cast in the mold, wherein the molten metal is maintained, within the treatment sequence going from the ladle to the casting mold, with a dissolved magnesium content close to at least 2 ppm, without exceeding the content, which depends on the oxygen content of the molten metal, above which solid magnesium-based spinels may form.

As will have been understood, at the basis of the invention is the discovery of the beneficial action of magnesium, in small amounts, in keeping the deoxidation inclusions in the liquid phase, whether these be present after killing or formed during casting in the presence of calcium. This is because it has been shown that the presence of magnesium in small amounts (namely at least about 2 ppm of Mg, and possibly up to 8–10 ppm for the oxygen contents usually encountered in aluminum-killed low-carbon or ultralow-carbon steels) within a calcium-treated molten metal has an influence on the physical nature of the inclusion population in the cast steel: the element magnesium considerably broadens the range of existence of liquid calcium aluminates at the casting temperature of the steel (approximately 1520–1570° C.). It should also be emphasized that such broadening is very sensitive to the presence of magnesium even in very small amounts, a small variation from a very low Mg content (a variation of less than 1 ppm) possibly resulting, as will be seen, in a consequent broadening of the meltability range.

BRIEF DESCRIPTION OF THE DRAWINGS

A clearer understanding of the invention will be gained and further aspects will become apparent in the light of the description which follows, given by way of example with reference to the appended single plate of drawings, in which.

DESCRIPTION OF THE PREFERRED EMBODIMENT

The ULC steel considered here has the following composition by weight, given in thousandths of a per cent, except in the case of nitrogen (N) which is given in ppm:

| C | Mn | P | S | Al | Si | Ti | Cr | Ni | N |
|---|---|---|---|---|---|---|---|---|---|
| <5 | 90–140 | 5–15 | 3–10 | 35–50 | 10–35 | 65–75 | 15–30 | 20 | 25–45 ppm |

This molten steel, coming from an oxygen converter for example, firstly undergoes a "vacuum" decarburizing treatment (in a refining station furnace-ladle for making the steel to grade, fitted with equipment to create a vacuum, or in an RH unit). Next, the molten metal is killed by adding aluminum. This element is supplied in an amount sufficient to reach the desired residual total oxygen contents of the molten metal, namely, taking into account the time needed for the aluminate inclusions to settle, of about 20 to 30 ppm of total (dissolved and bound) oxygen within the tundish, and therefore just before casting.

At the same time, or just after the aluminum has been added, an addition of calcium is made by introducing a consumable Si—Ca cored wire into the molten metal. Depending on the requirements, and bearing in mind the low efficiency with which an element having a high vapor pressure of this type dissolves in the molten metal (an efficiency of about 10–15%, if care is taken), the addition of Ca is adjusted so as to obtain a total Ca (dissolved Ca and Ca bound in the form of aluminates and sulphides) of about 25 ppm.

As regards the magnesium, this may be introduced at any moment after deoxidation by the aluminum, either separately or simultaneously with the calcium if the latter is added after deoxidation.

The addition of magnesium in a small amount in accordance with the invention may be performed in the ladle, or possibly in the tuhdish, by means of a consumable cored wire, for example made of an Ni—Mg alloy, which melts in the molten steel as it is introduced thereinto.

The intended minimum dissolved Mg content of 2 ppm may also be achieved by metal-slag equilibrium using a slag of suitable composition which is to be formed on the in-ladle molten metal. For example, it will be suitable to use a basic slag containing up to 10% MgO by weight, an example of the composition of which is as follows (the values are percentages by weight): $Al_2O_3$: 56%; MgO: 3%; CaO: 41%.

Figure 1:
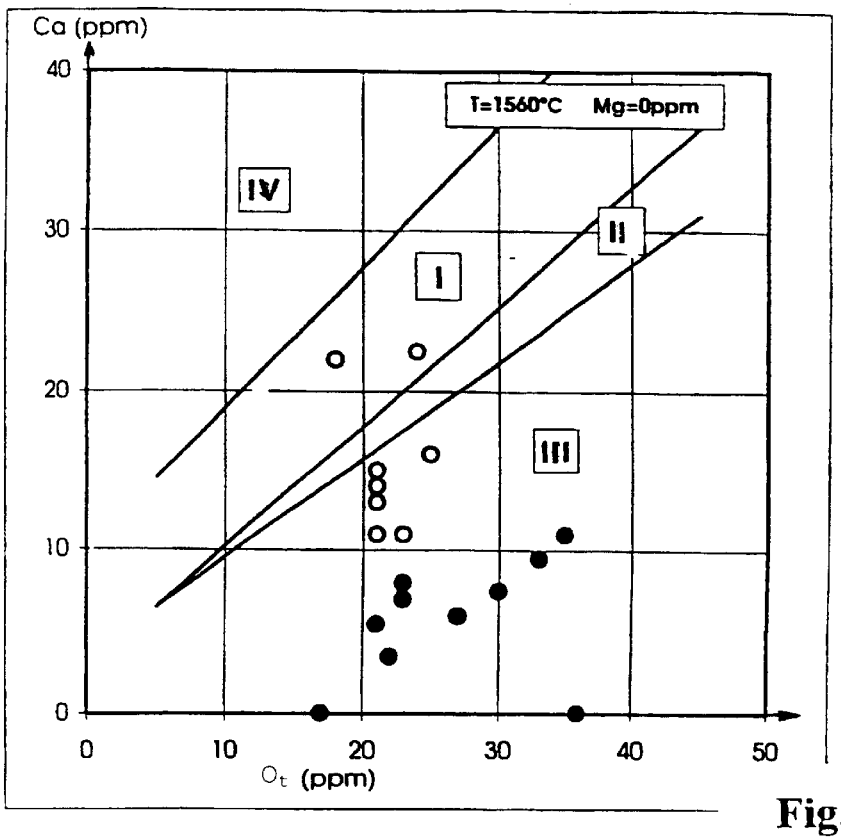
FIG. 1 is a phase diagram showing the ranges of inclusion precipitation at 1560° C. (the casting temperature) in an ultralow-carbon grade steel as a function of the calcium content, plotted on the y-axis, and the total (dissolved and bound) oxygen content plotted on the x-axis, in this case without any magnesium, other than in trace amounts (less than 0.1 ppm)
Figure 2:
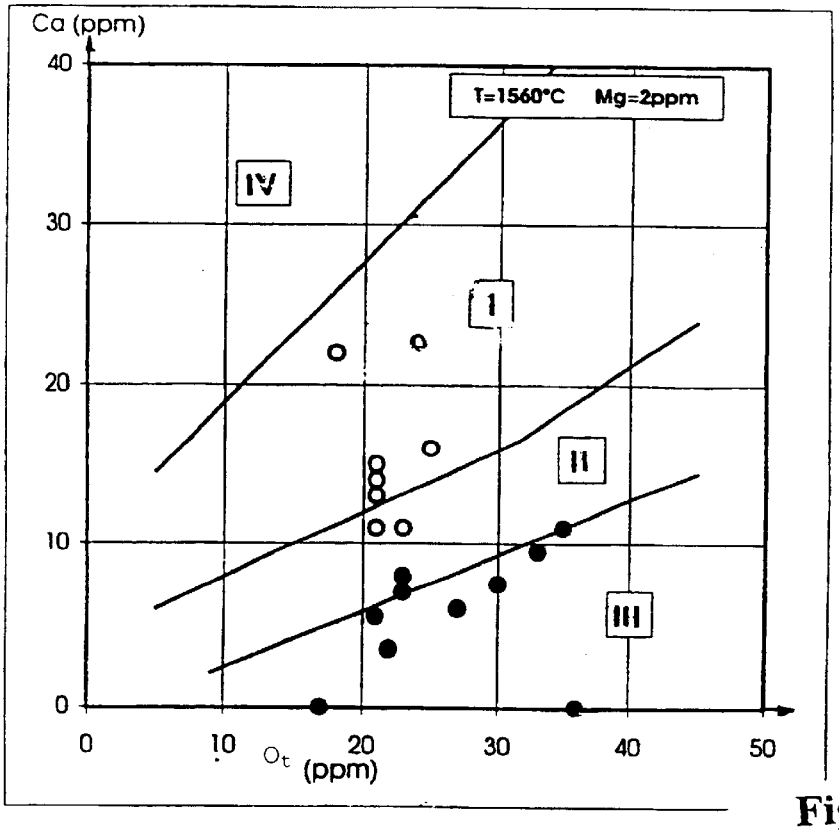
FIG. 2 is a diagram similar to that in FIG. 1, showing the same situation but with a magnesium content of the molten metal of 2 ppm; (both these diagrams include symbols representative of casting sequences for which blockages have occurred (solid symbols) or have not occurred (open symbols))

The results obtained, at a casting temperature of 1560° C., on the broadening of the range of meltable inclusions thanks to the treatment with magnesium present with its minimum content of 2 ppm may be seen in FIG. 2 with respect to FIG. 1, the latter figure recording, all other things being equal, the situation without magnesium treatment.

Simple visual comparison between FIGS. 1 and 2 immediately shows the beneficial effect of the presence of a small amount of magnesium on the broadening of the meltability range I of the deoxidation inclusions (calcium aluminates) within a molten ULC steel. The broadening is in fact downward, that is to say toward the lowest contents of treatment calcium, or, expressed another way, for a given calcium content, toward the highest oxygen contents. Moreover, this shows, at the same time as an overall downward shift, a corresponding broadening of the lower neighboring range II (low % Ca) in which the oxides are partially liquid, whereas the upper neighboring range IV (high % Ca) remains the range in which the oxides are liquid, but together with a calcium sulfide precipitate. It will be noted that the upper limit on the meltability range (the transition from region I to region IV) depends, not on the Mg content, but on the sulfur content, all other things being equal of course.

In contrast, the entire region III of the diagrams, lying below the transition range II, namely that in which the deoxidation inclusions are in the solid phase, is substantially reduced by the effect of conjugate broadening of the liquid range I and of the lower adjacent transition range II.

Now focusing attention on the small circular symbols placed on each of these two figures, the good correlation existing between the broadening of the meltability range I, thanks to the small amount of magnesium, in accordance with the invention, and the phenomenon of blockage of the casting nozzle may be appreciated. The small empty geometrical symbols record the successful casting runs, therefore without blockage, while the solid black symbols indicate casting runs which have suffered from significant blockages. It should be explained that these symbols are the results of analytical determinations of the total calcium and oxygen contents of specimens removed for analysis from the tundish halfway through casting.

As may be seen, the level of dissolved calcium, above which liquid oxides form, corresponds well to the level of dissolved calcium above which the castability of the steel improves.

In accordance with the invention, achieving a low magnesium content and keeping it at this level, from the tapping ladle (the place where the secondary metallurgy for making adjustments to the final grade and the killing are carried out) right to the casting mold, consequently provide:

greater flexibility in the in-ladle calcium treatment, since the range of permissible contents is greater when magnesium is present, especially toward low calcium contents, as was seen; and better reproducibility of the results: since the effect of the magnesium, even in very small amounts, is very sensitive over the inclusion precipitation range, it is possible easily to pass into the range in which the oxides are in the liquid phase, if this is not controlled.

It goes without saying that the invention should not be understood to be limited to the example described, but extends to numerous variants or equivalents provided that its definition given by the appended claims is respected.

In particular, it will have been understood that, although the results intended by the invention may be obtained already from implementing it with a minimum magnesium content of the molten metal of approximately 2 ppm, this value is merely a lower limit which, given the usual oxygen contents of the final molten metal, guarantees, without fail, improved castability. In other words, the invention can produce even better results with respect to the broadening of the meltability range I of the inclusions if care is taken to adjust the Mg content according to the actual oxygen content of the molten metal so as to approach, but taking care not to reach, the value at which the Mg starts to form solid spinels of MgO, the presence of which within the metal to be cast would then nullify the benefits of the invention with regard to the prevention of nozzle blockages.

Figure 3:
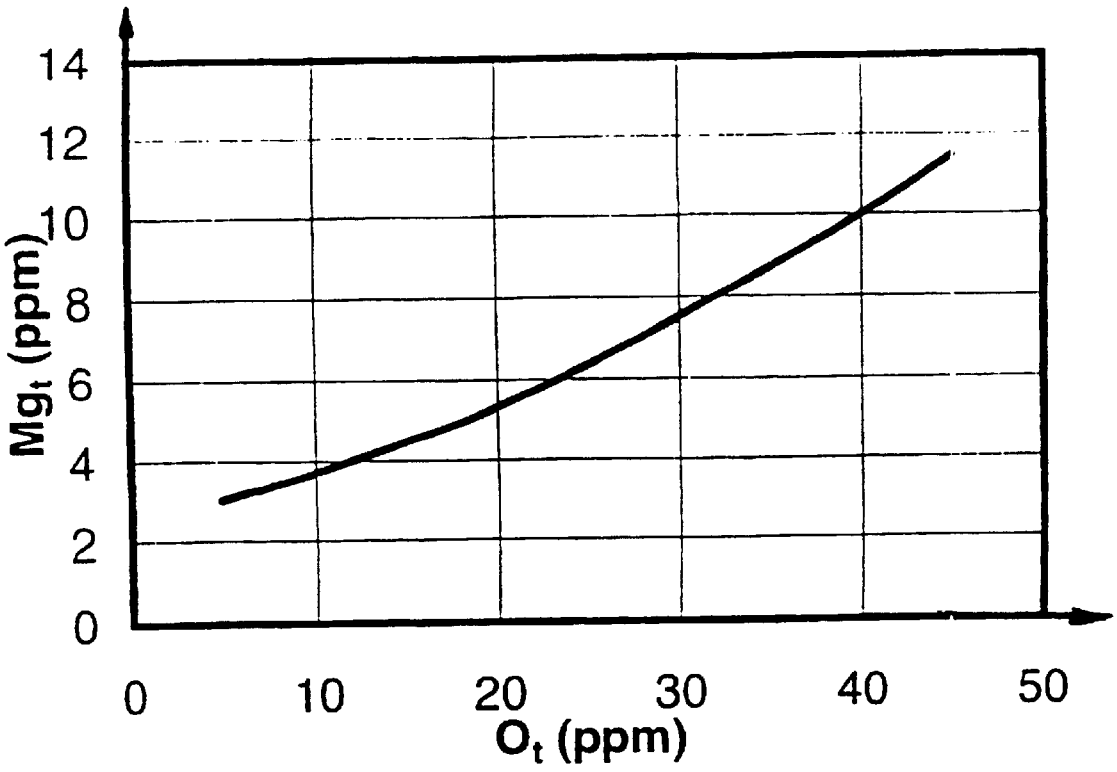
FIG. 3 is a graph showing the change in the permitted maximum content of magnesium dissolved in the molten steel as a function of the total (dissolved and bound) oxygen content of the molten steel, it being understood that the calcium content in question corresponds to the minimum value required in order to have liquid oxides without addition of magnesium.

FIG. 3 shows specifically, in the form of a graph, the upper limiting value of the Mg content as a function of the total oxygen content of the molten metal above which these undesirable spinels form within the molten steel at the casting temperature. It will be recalled that the Ca content in question corresponds to the minimum value for having oxides in the liquid state without addition of Mg. As may be seen, the curve representative of this upper limiting value increases uniformly with increasing oxygen content. Thanks to the characteristics of its low origin, it may be clearly seen that an Mg content of approximately 2 ppm makes it possible always to be below the limiting threshold for spinel formation, whatever the level of oxygenation of the molten metal. It may also be seen, turning one's attention to halfway along the curve, that at total oxygen contents of 20 to 30 ppm, which are values ordinarily achieved at the present time in the case of ultralow-carbon steels, the limiting value not to be exceeded lies around 6 ppm, plus or minus 2 ppm depending on whether the oxygen content is close to 30 ppm or close to 20 ppm.

What is claimed is:

1. A process for the metallurgical treatment of a molten ultralow- or low-carbon steel to be continuously cast, comprising:

killing the molten ultralow- or low carbon steel with aluminum in order to achieve a given oxygen content, so as to form deoxidation inclusions having a melting point below the temperature at which the steel is cast in the mold;

adding magnesium after the steel has been killed with aluminum;

wherein the molten metal is maintained during a treatment sequence going from a ladle to a casting mold, with a dissolved magnesium content of between a minimum value of approximately 2 ppm and a maximum value of 10 ppm.

2. The process as claimed in claim 1, wherein magnesium is introduced into a tapping ladle and wherein magnesium content is maintained within the molten metal by metal-slag exchange using a basic slag containing up 10% MgO by weight.

3. The process as claimed in claim 1, wherein magnesium is introduced in the form of consumable cored wire.

4. The process as claimed in claim 3, wherein the consumable cored wire comprises Ni—Mg.

5. The process as claimed in claim 1, wherein the calcium is introduced in the form of a consumable Si—Ca cored wire.

6. The process as claimed in claim 1, wherein the calcium is added so as to obtain a total Ca of about 25 ppm.

7. The process, as claimed in claim 1, wherein the magnesium is introduced into a tundish.

8. The process, as claimed in claim 1, wherein liquid calcium aluminates exist in the steel at casting temperatures of from 1520 to 1570° C.

9. The process as claimed in claim 1, wherein the residual total oxygen content of the steel is about 20 to 30 ppm of the total oxygen just before casting.

* * * * *